US006837401B2

(12) United States Patent
Groys

(10) Patent No.: US 6,837,401 B2
(45) Date of Patent: Jan. 4, 2005

(54) APPARATUS AND METHOD FOR DISPENSING VAPOCOOLANTS

(75) Inventor: Aleksandr Groys, Beachwood, OH (US)

(73) Assignee: Gebauer Company, Cleveland, OH (US)

( * ) Notice: Subject to any disclaimer, the term of this patent is extended or adjusted under 35 U.S.C. 154(b) by 155 days.

(21) Appl. No.: 10/343,723

(22) PCT Filed: Sep. 21, 2001

(86) PCT No.: PCT/US01/29627

§ 371 (c)(1),
(2), (4) Date: Jan. 31, 2003

(87) PCT Pub. No.: WO02/24548

PCT Pub. Date: Mar. 28, 2002

(65) Prior Publication Data

US 2004/0040978 A1 Mar. 4, 2004

Related U.S. Application Data

(60) Provisional application No. 60/234,488, filed on Sep. 22, 2000.

(51) Int. Cl.[7] ..... B65D 83/00

(52) U.S. Cl. ..... 222/189.11; 222/402.12; 222/494; 222/402.1

(58) Field of Search ..... 222/91, 137, 402.13, 222/402.12, 402.1, 494, 571

(56) References Cited

U.S. PATENT DOCUMENTS

| | | | | | |
|---|---|---|---|---|---|
| 4,035,303 | A | * | 7/1977 | Ufferfilge | 222/189.11 |
| 4,141,472 | A | * | 2/1979 | Spitzer et al. | 222/189.01 |
| 5,273,191 | A | | 12/1993 | Meshberg | 222/105 |
| 5,988,449 | A | * | 11/1999 | Fuchs et al. | 222/189.11 |

* cited by examiner

*Primary Examiner*—Philippe Derakshani
(74) *Attorney, Agent, or Firm*—Pearne & Gordon LLP

(57) ABSTRACT

An apparatus and method for discharging vapocoolants in stream or mist form includes the use of selected fluoroelastomers for valve parts to regulate discharge. The fluoroelastomers provide long-term stability to the vapocoolants to enable superior shelf life without minimal loss or contamination of the vapocoolant. In addition, a filter is provided to remove contaminants from vapocoolant prior to passage through the nozzle opening.

53 Claims, 4 Drawing Sheets

APPARATUS AND METHOD FOR DISPENSING VAPOCOOLANTS

BACKGROUND OF THE INVENTION AND RELATED ART

This application claims the priority of provisional application Ser. No. 60/234,488, filed Sep. 22, 2000.

The present invention relates to apparatus and methods for delivery of topical anesthetics and refrigerants, hereinafter collectively referred to as vapocoolants. More particularly, the apparatus comprises containers, associated valve arrangements and, optionally, filters that provide a long shelf life and maintain delivery characteristics over the shelf life in a manner suitable for pharmaceutical applications. The apparatus operates over a range of pressure commonly encountered in medical applications to provide substantially uniform delivery of vapocoolant. The apparatus may be constructed to provide either a stream or a mist delivery.

Preferred vapocoolants include ethyl chloride, ethyl chloride-fluorocarbon blends, fluorocarbon fluids and blends of fluorocarbon fluids such as 15% dichlorodifluoromethane and 85% trichloromono-fluoromethane. Also, non-halogen containing low boiling fluids suitable for topical skin application may be used. The vapocoolant will typically operate as a self-propellant by providing a suitable pressure for discharge in a vapor space above the liquid supply of vapocoolant. However, an inert gas such as nitrogen may be combined with the vapocoolant to achieve modified discharge characteristics. For convenience, the invention is described hereinafter with particular reference to ethyl chloride.

Ideally, the containers and associated valve arrangements for ethyl chloride should have a shelf life of three years and meet United States Pharmacopoeia ("USP") specifications as well as standard aerosol requirements for functionality. As discussed more fully below, certain medical applications also require unique jet stream characteristics over the life of the product. The USP specification for residue in ethyl chloride is 100 ppm.

Heretofore, valve-actuated spray bottles and so-called metal tube containers have been used for delivery of stream and mist flows of vapocoolant. Although such apparatus have provided effective delivery, they have not been entirely satisfactory. More particularly, it has not been possible to economically modify the prior art apparatus to comply with current FDA regulations and commercial production standards. Most notably, undesirable rates of product lost due to valve leakage have been experienced in connection with bottle apparatus. Although the metal tube apparatus provides substantially satisfactory performance, the cost of this delivery system including its threaded valve actuator is not economically attractive.

A current metal can spray system having a button actuated valve has not complied with contaminant or residue standards. That is, the vapocoolant within the spray can contains dissolved or dispersed contaminants believed to result from the solvent action of the vapocoolant on internal polymeric components of the spray can.

The vapocoolants may be used in topical application procedures requiring precise control of the area of skin contacted by the applied stream. For example, treatment of certain myofascial pain syndromes with vapocoolant in combination with stretching procedures may inactivate a trigger point and relieve the patient's pain. A discussion of myofascial pain and myofascial trigger points is provided in the International Rehabilitation Medicine Association monograph, *Myofascial Pain Syndrome Due to Trigger Points*, by David G. Simons M. D., November 1987, incorporated herein by reference. One specific myofascial therapy is the stretch and spray method of treatment which permits gradual passive stretch of the muscle and inactivation of the trigger point mechanism. To that end, a jet stream of vapocoolant is applied to the skin in one-directional parallel sweeps. Initially, one or two sweeps of spray precede stretch to inhibit the pain and stretch reflexes. The spray of vapocoolant is applied slowly over the entire length of the muscle in the direction of and including the referred pain zone. As described, the stream flow and size characteristics together with precise positioning of the vapocoolant along the muscle being treated is important to achieve inactivation of the trigger point mechanism.

In such procedures, a stream delivery of relatively small dimension is preferred. For example, the diameter of the stream at the valve nozzle may be in the range of several thousandths of an inch, e.g., from about 0.004" to about 0.015". Preferably, the delivery flow is stable and the stream configuration is sufficiently maintained to achieve the desired skin contact area with the valve nozzle being positioned up to about 10 or 15 inches from the patient.

In order to achieve such stream stability, the fluid delivery components of the container must not be affected excessively by changes in pressure that occur with change of container orientation during stream application and reduction of the vapocoolant supply within the container during the application life of the container, i.e. the time period within which the container is periodically used before emptied of vapocoolant. Similarly, the button valve itself must receive the flow of vapocoolant from the supply thereof within the container and establish satisfactory fluid flow characteristics prior to the exit of the fluid from the nozzle opening.

The achievement of a fine jet stream requires a nozzle having a highly uniform orifice or opening that is free of dimensional irregularities. For example, a nozzle opening having a diameter of about 0.005" preferably has a size tolerance of ±0.0005" along a length in the order of 0.02".

The reliable provision of such jet stream flows has heretofore been inhibited by the presence of contaminants which may result from in situ formed solid residues or derived from the spray apparatus including the container, valve, actuator and/or flow passage surfaces contacted by the vapocoolant. Such contaminants may partially block or otherwise sufficiently inhibit or alter flow through the nozzle discharge bore and/or opening so as to prevent the achievement of the desired jet stream. Such contaminants may result from plastic dip tubes and actuator elements that retain manufacturing debris of extremely small size, e.g., elongated flash debris having a 0.0005" diameter and a 0.010" length. Cleaning techniques including washing and vacuum removal are economically undesirable and often not sufficiently reliable.

SUMMARY OF THE INVENTION

It has now been found that effective and economical container apparatus and methods may be provided for delivery of stream and mist flows of vapocoolant through the judicious selection of polymeric components in accordance with the specific vapocoolant and the operating characteristics of the valve apparatus within the container.

It had also been found that fine jet stream flows of vapocoolant may be reliably provided with filtering of the vapocoolant. The vapocoolant is filtered within the container apparatus by a filter sized to remove debris of a size typically associated with the manufacture of the dispensing apparatus components.

Further, the container apparatus may include button-type actuators designed to cooperate with the coacting valve apparatus within the container to yield stable sealing resulting in long-term shelf life, e.g., in the order of two years. Similarly, uniform delivery and flow characteristics are achieved as the contents of the container are used during the application-life of the container.

The valve arrangement includes a sealing surface of fluoroelastomer that has been found to provide chemical and physical stability in respect to vapocoolants in combination with resiliency characteristics necessary to long-term fluid tight sealing engagement. Surprisingly, this has been achieved in connection with button type actuators which are characterized by relatively low valve actuation forces of 4 to 9 lbs. as contrasted with the threaded valve actuators of the prior art. Moreover, this has been achieved in the harsh chemical environment of an ethyl chloride system. As noted above, such was not heretofore possible without the use of an economically unattractive threaded valve arrangement for dispensing the vapocoolant.

Accordingly, the fluoroelastomer compositions may be selected to afford the necessary inertness and sealing resiliency properties to enable an economical vapocoolant delivery container having an acceptable shelf life. Useful fluoroelastomer compositions are characterized by the following properties.

1. A durometer shore A value of 50 to 100 and more preferably 80 to 90, as measured by ASTM D2240;

2. Low permeability measured as product loss from assembled can through valve assembly in the range of less than about 3.0 g/year and preferably from about 1.0 to 2.0 g/year or less;

3. Chemical inertness in respect to ethyl chloride as characterized by gas chromatography characterization of impurities equal to less than 100 ppm;

4. A dimensional stability that exhibits limited dimensional change as required by valve design and, for example, about ±5%;

5. Low solid residue in ethyl chloride as characterized by ethyl chloride USP non-volatile residue test, the non-volatile residue less than 200 ppm.

Using the foregoing guidelines, a suitable gasket for a valve arrangement in an ethyl chloride system was formed using a commercially available fluoroelastomer sold under the DuPont trademark Kalrez 6185. Kalrez is a perfluoroelastomer that is a copolymer of tetrafluoroethylene and perfluoromethyl vinyl ether with small amounts of a perfluorinated comonomer to provide chemical cross linking sites.

In the foregoing application, a button actuated valve was fitted to a metal container or can. It is estimated that the valve spring developed a valve closing force of less than 5 lbs. A shelf life of about two years was achieved with little or no loss of the ethyl chloride from the metal can. Similarly, minimal contamination from solid residue occurred. Solid residue was raised by about 70 ppm over the raw material.

Similar resins include Kalrez 6221 or 6230 which are also perfluoroelastomer. Additional useful resins are sold by DuPont under the trademark Zalak.

Other polymeric components within the container should also be selected with regard to the properties of the vapocoolant. In the case of ethyl chloride, it has been found that the dip tube may be formed of a fluorocarbon resin such as polytetrafluoroethylene.

The container may comprise an aluminum or steel can. Presently, it is preferred to use polymeric liners for the can interiors of aluminum. In the case of aluminum, a liner of polyamide/imide resin may be used, but an unlined container is preferred. In the case of steel, a liner of epoxy/phenolic resin may be used. These resins are known in the art and they are commercially available.

In accordance with the foregoing guidelines, one skilled in the art may select useful fluoroelastomers by trial and error to provide a valve arrangement and container for a particular vapocoolant.

For purposes of achieving a fine jet stream of suitable dimension and sufficient integrity to enable the precision application of the vapocoolant required in certain myofascial treatments, suitable nozzle discharge bore sizes and lengths have been identified. Moreover, it has been found that such nozzles are conveniently formed of metallic materials in order to better maintain dimensional tolerances and geometric configurations.

The reliability of the container apparatus to provide such fine jet stream flows has been enhanced by filtering of the vapocoolant. More particularly, the container apparatus is provided with an in situ filter located in the flow path of the vapocoolant stream. Preferably, the filter is positioned immediately upstream of the nozzle discharge bore.

DETAILED DESCRIPTION OF THE DRAWINGS

Figure 1:
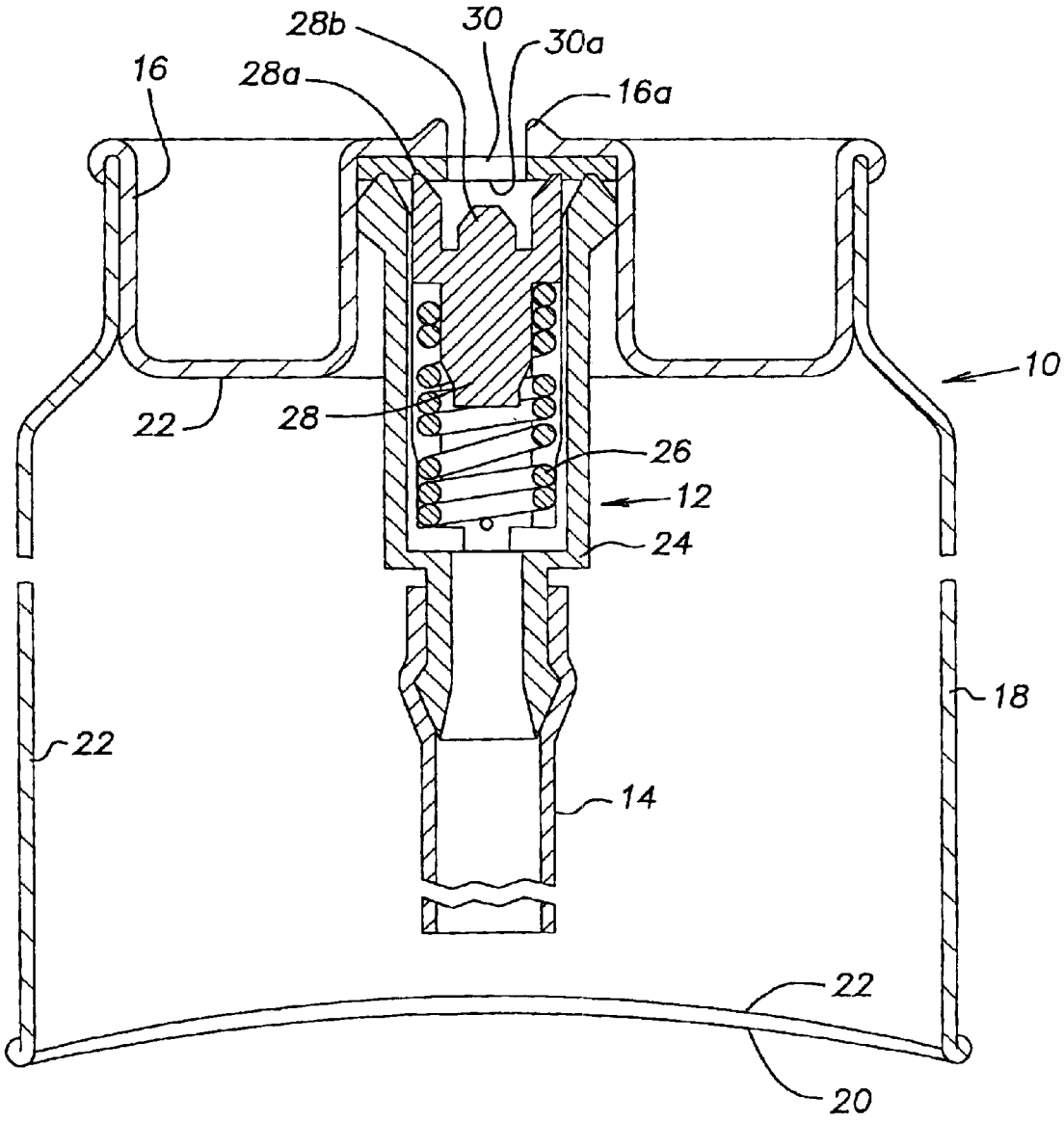
FIG. 1 is a sectional view of a container having a valve arrangement in accordance with the present invention.

Referring to FIG. 1, a container 10 includes internally mounted co-acting valve apparatus 12 having a dip tube 14. The container 10 comprises a hermetically sealed metal can including an upper mounting cup 16, a side wall 18 and a bottom wall 20. The side wall 18 is secured to the upper cup 16 and bottom wall 20 in a fluid-tight rolled joint.

The interior surfaces of the container 10 may be provided with a protective polymeric coating or film 22. As noted above, a polyamide/polyimide (PAM) resin may be used on aluminum, and an epoxy/phenolic resin may be used on steel, but an unlined container is preferred.

The container 10 is sized to hold about 3.5 ounces of vapocoolant. However, containers may be sized to hold from about 1 ounce to about 10 ounces. The cross-sectional area of the container is selected to assure development of a vapor pressure sufficient to discharge the contents of the container.

The valve apparatus 12 includes a valve body 24 having a coil spring 26 mounted therein. Spring 26 is arranged to resiliently bias a spring cup 28 into sealing engagement with a gasket 30.

The valve body 24 and spring cup 28 may be formed of a resin material that is resistant to the ethyl chloride environment. For example, the body 24 and cup 28 may be formed of a polyamide resin such as nylon.

The spring 26 is formed of stainless steel and has a spring force sufficient to maintain a fluid tight seal between the cup 28 and gasket 30. Suitable springs have been formed of stainless steel wire having a diameter of 0.027". The spring is arranged in a coil configuration having an axial length of about 0.45" and a diameter of about 0.2". Satisfactory performance may be obtained with valve actuation forces ranging from 3 to 15 lbs. and more preferably, from about 5.5 lbs. to about 8 lbs.

The gasket 30 has an annular shape. It is formed by extrusion of the perfluoroelastomer sold under the trademark Kalrez 6185. More particularly, the elastomer is extruded in a tubular form with an outside diameter of about 0.375" and an inside diameter of about 0.139". The extrusion is transversely sliced to form the gasket 30 with a thickness of from about 0.035" to about 0.060", and more preferably, 0.042". These gasket dimensions have been found to provide suitable sealing with an annular engaging lip 28*a* provided by the spring cup 28 under the bias of the spring 26.

It should be appreciated that the upper mounting cup 16 is shown prior to clinching or crimping engagement with the valve apparatus 12. During clinching, the central hub of the cup 16 is radially compressed or clinched to firmly engage the upper annular portion of the valve body 24. The clinching process reduces the inside diameter of the gasket 30. An acceptable inside diameter range has been found to be from about 0.115" to about 0.125".

Figure 2:
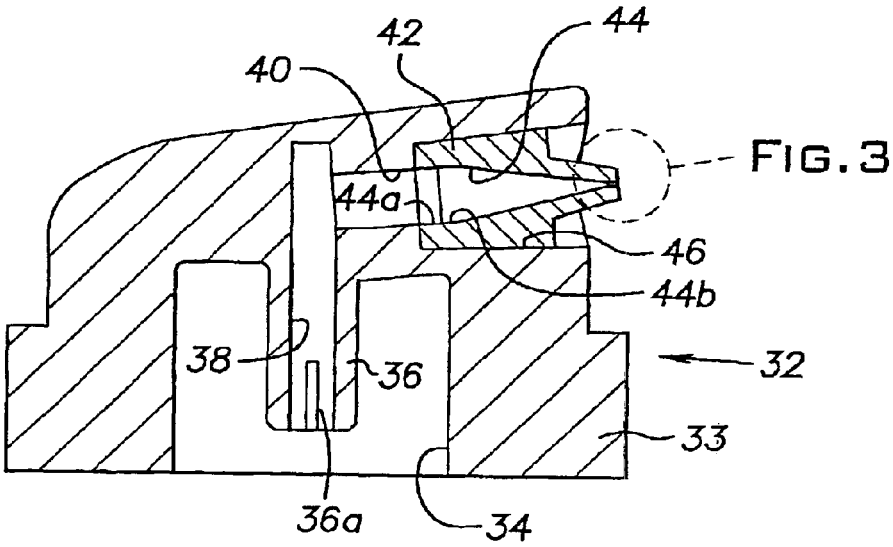
FIG. 2 is a sectional view of a button valve actuator including an insert nozzle for providing stream delivery in accordance with the present invention.

Referring to FIG. 2, a button valve actuator 32 arranged to deliver a stream of vapocoolant is shown. The actuator 32 includes a body portion 33 having a mounting opening 34 sized to be mounted with a sliding friction fit to a central cap engaging lip 16*a* of the cup 16. The actuator 32 includes an annular operating leg 36 arranged to engage a central push-bulb 28*b* formed in the spring cup 28 when the actuator 32 is mounted to the lip 16*a*.

The body portion 33 of the actuator 32 is formed of a polyamide resin such as nylon. A suitable nylon resin is sold by DuPont under the trademark Zytel.

The actuator 32 is arranged to be mounted to the central hub, or more particularly, the lip 16*a* of the cup 16 to permit limited axial movement towards the container 10. Accordingly, the actuator 32 may be moved downward towards the container 10 to cause the operating leg 36 to move the spring cup 28 axially into the valve body 24 against the bias of the spring 26. In this manner, the engaging lip 28*a* of the spring cup is moved out of sealing engagement with lower surface 30*a* of the gasket 30.

When the valve is opened by operation of the actuator 32 to move the lip 28*a* away from the surface 30*a*, vapocoolant rises through the dip tube 14 and passes through the valve body 24 into a slot 36*a* formed in the leg 36. The vapocoolant then passes into a first bore 38 extending through the leg 36 and communicating with a second bore 40 disposed in an upper region of the actuator 32. The second bore 40 extends to a nozzle insert 42 having a tapered discharge bore 44. The nozzle insert 42 is press-fitted into a nozzle mounting bore 46.

The nozzle insert includes a cylindrical portion having a diameter of about 0.2" and an axial length of about 0.2". A tip extends about 0.1" from the spray end of the cylindrical portion. Accordingly, the total axial length of the nozzle insert is about 0.3". The nozzle insert is formed of a suitably inert resin, such as an acetyl resin sold under the trademark Celcon M70.

Figure 3:
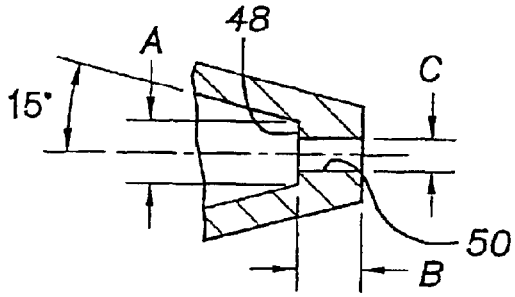
FIG. 3 is a sectional view on an enlarged scale of a portion of the nozzle tip as shown in FIG. 2.

The discharge bore 44 is provided with a smooth surface and a relatively shallow angle of inclination equal to about 15° from the center line to the adjacent interior surface so as to provide a cone angle of about 30°. The bore 44 includes a cylindrical portion 44*a* that has an inside diameter of 0.090" and a length of 0.060". The portion 44*a* extends to a cone portion 44*b* that is symmetrical about its longitudinal axis and terminates at a front surface 48 having a diameter "A" (FIG. 3) equal to 0.025" to 0.030". A nozzle orifice or opening 50 has an axial length "B" (FIG. 3) equal to 0.015" to 0.020" and a diameter "C" (FIG. 3) equal to 0.008". The insert 42 has a total axial length of 0.300".

The nozzle insert 42 has been found to be securely fixed within the bore 46 by friction without measurable distortion of the stream emitted through the nozzle opening 50. That is, a stream having a diameter of about 0.008" is emitted and the stream configuration is maintained at application distances ranging up to about 20 inches.

Figure 4:
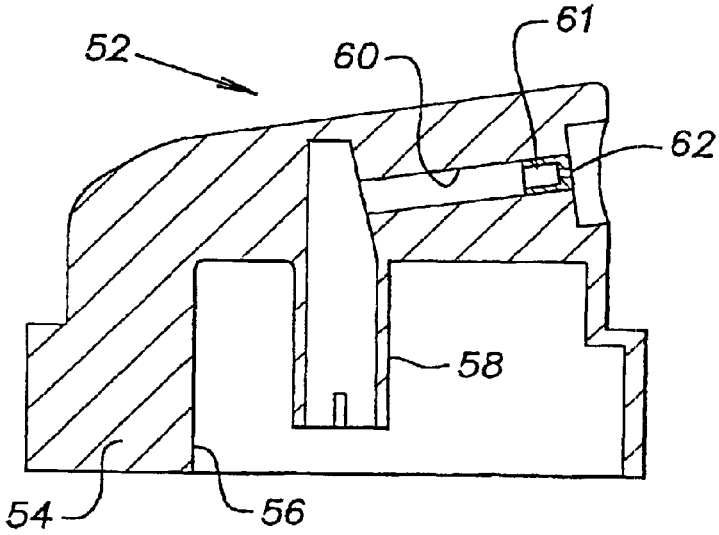
FIG. 4 is a sectional view of a button valve actuator constructed to provide a mist delivery in accordance with the present invention.

Referring to FIG. 4, a button valve actuator 52 arranged to deliver a mist of vapocoolant is shown. The actuator 52 includes a body portion 54 having a mounting opening 56 and an annular operating leg 58. The actuator 52 may also be formed of the same polyamide resin as described above with respect to the actuator 32.

The mounting of the actuator 52 to the container 10 and its operation of the valve apparatus 12 is similar to that described above with respect to the actuator 32. Accordingly, this discussion is not repeated.

The delivery of a mist spray is achieved with a discharge bore 60 formed in the body portion 54 of the actuator 52. The discharge bore 60 has a substantially cylindrical configuration and receives a mist spray insert 61 that terminates at a nozzle opening 62. The circular cross section of the discharge bore 60 and nozzle opening 62 may range in diameter from 0.010" to 0.030", and more preferably, 0.015".

The mist spray emitted from the nozzle opening 62 compresses a dispersed flow of vapocoolant. The cone shape may be of about a 45° angle. A vapocoolant flow rate of about 0.3 grams/second is typical.

It should be appreciated that the dip tube 14 may be omitted to limit the container 10 to inverted-type use. Of course, internal valve apparatus may also be used to enable container operation in substantially any orientation.

Figure 5:
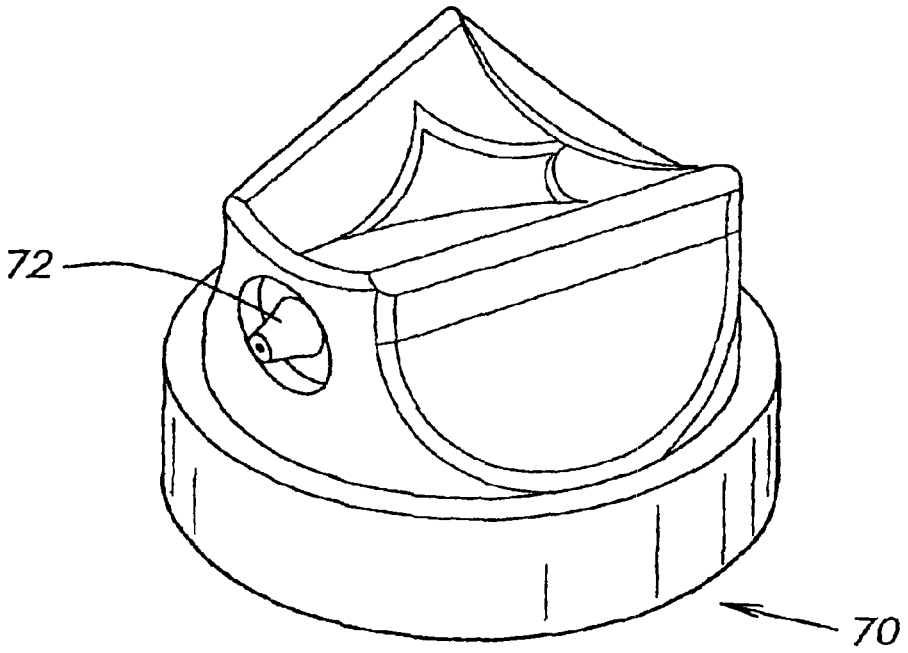
FIG. 5 is a perspective view of a button valve actuator for providing stream delivery in accordance with another embodiment of the invention.
Figure 6:
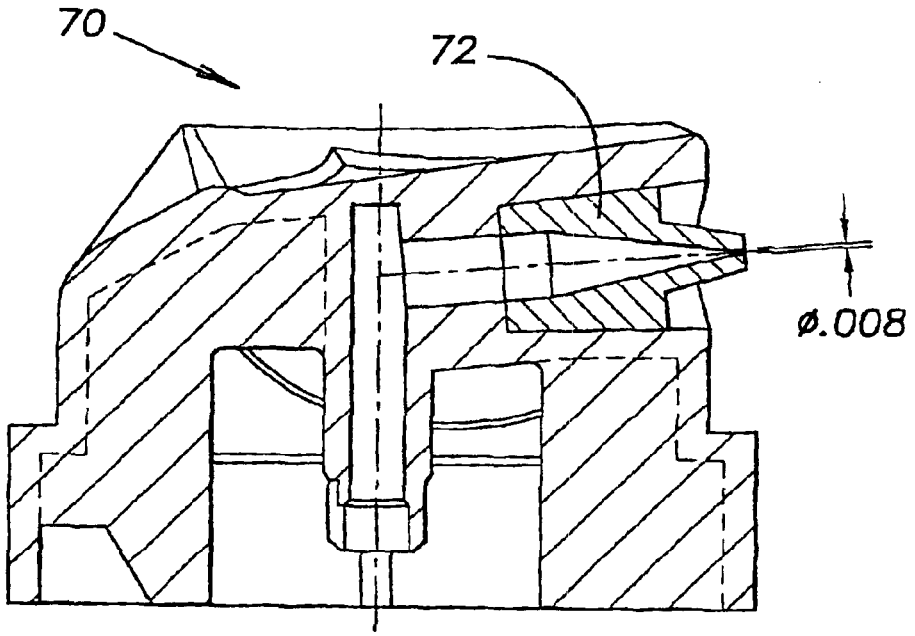
FIG. 6 is a sectional view on an enlarged scale of the button valve actuator shown in FIG. 5.

Referring to FIGS. 5 and 6, a button valve actuator 70 in accordance with another embodiment is shown. The valve actuator includes an insert 72 that emits a jet stream.

Figure 7:
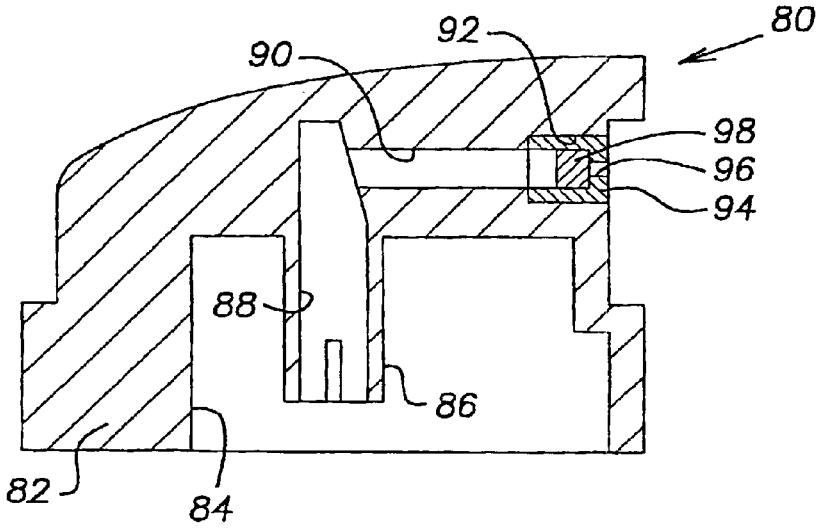
FIG. 7 is a sectional view of a button valve actuator including a nozzle and a filter for providing stream delivery in accordance with another embodiment of the invention.

Referring to FIG. 7, a button valve actuator 80 arranged to deliver a jet stream of a vapocoolant is shown. The actuator 80 includes a body portion 82 having a mounting opening 84 and an annular operating leg 86. The actuator 80 may also be formed of the same polyamide resin as described about with respect to the actuator 32.

The mounting of the actuator 80 to the container 10 and its operation of the valve apparatus 12 is similar to that described above with respect to the actuator 32. Accordingly, the annular leg 86 includes a first bore 88 communicating with a second bore 90 that terminates at a nozzle mounting bore 92. A nozzle 94 having a nozzle orifice or opening 96 is mounted with an interference fit in the bore 92. The valve apparatus 12 and annular leg 86 cooperate with the bores 88 and 90 to provide a passageway to convey liquid vapocoolant from the supply thereof in the container 10 to the nozzle 94 for discharge through the nozzle opening 96.

The nozzle 94 may be provided with various exterior configurations as required in a particular actuator structure. The nozzle 94 is preferably formed of a metallic material such as brass or stainless-steel. The use of such a metallic material facilitates the provision of the nozzle opening 96 with dimensions sufficiently small to provide the desired jet stream. For example, electrical discharge machining (EDM) may be used to form the opening 96 with uniform dimensions and surfaces substantially free of irregularities in the nature of burrs or other shaping defects. Of course, the opening 96 may be formed by other manufacturing techniques such as drilling or laser cutting.

The nozzle orifice or opening 96 may range in diameter size from 0.004" to 0.015" with a tolerance of about 0.0005" and a length of about 0.02". A smaller diameter size tends to overly limit the flow of vapocoolant so that the cooling therapeutic effect is not obtained upon impingement of the stream on the skin. Increasing pressures do not provide sufficient increases in flow and/or tend to cause splash back at relatively high pressures, e.g., 60 psi, which tends to inhibit the desired skin cooling effects. On the other hand, diameter sizes greater than about 0.015" tend to result in liquid vapocoolant flows that are too high and are not easily limited to the desired contact width to treat specific muscles. If the pressure is excessively decreased, e.g., to values less than about 4 psi, the required jet stream is not achieved.

In preferred applications, a fine jet stream may be achieved with a nozzle opening diameter size in the range of from about 0.005" to about 0.007". At a pressure of about 5 psi, such a jet stream will expand to a diameter of about 0.010", and no more than about 0.015", after traveling about 4" from the nozzle opening.

A slightly larger medium jet stream may be achieved with a nozzle opening diameter size in the range of from about 0.007" to about 0.009".

Figure 8:
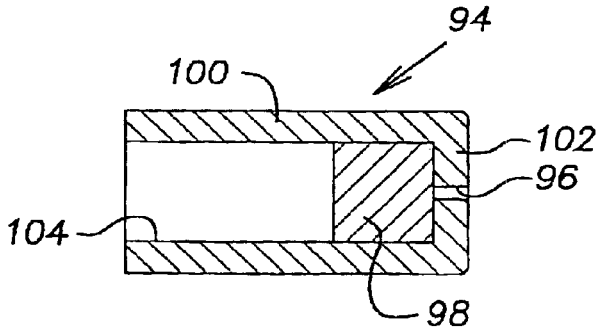
FIG. 8 is a sectional view on an enlarged scale of the nozzle and filter shown FIG. 7.

Referring to FIG. 8, a filter 98 is mounted upstream of the nozzle opening 96. More particularly, the nozzle 94 has a cylindrical shape including a sidewall 100, a front wall 102 and a rearwardly opening bore 104. The filter 98 is sized to fit tightly within the bore 104 adjacent the front wall 102 and the inlet of the nozzle opening 96. In this manner, the vapocoolant is filtered immediately prior to entering the opening 96 to substantially prevent any contaminants from entering the opening.

As previously discussed, the contaminants primarily comprise manufacturing debris associated with the dip tube, valve and actuator as well as the container. The filter may be sized to accommodate expected levels of contaminants without impeding the flow of the vapocoolant so as to prevent formation of the desired jet stream.

Figure 9:
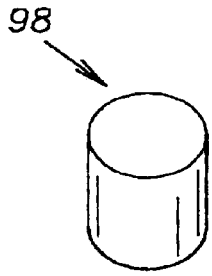
FIG. 9 is a perspective view on an enlarged scale of the filter shown in FIGS. 7 and 8.

Referring to FIGS. 8 and 9, the filter 98 has a cylindrical shape and an outside diameter sized to fit in the bore 104. The filter 98 is formed of sintered 303 stainless-steel having a pore size of 50±10 microns. As shown, the filter 98 is in the pathway of the flowing liquid vapocoolant and is designed to have a pressure drop of less than about 5 psi. Of course, the pressure drop design of the filter must take into consideration the density of the particular liquid vapocoolant. Also, as noted above, the filter is provided with a capacity sufficient to capture expected levels of contaminants without significantly affecting the flow of liquid vapocoolant and the resulting jet stream. For example, the filter 98 having a diameter of about 0.08" and a thickness of about 0.08" has been found to provide a suitable filtering capacity for 5 oz. polymeric lined metal can containers with plastic dip tube, valve and actuator constructions.

Figure 10:
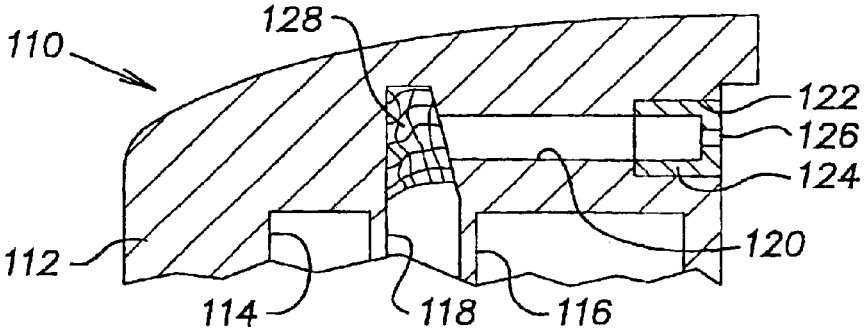
FIG. 10 is a fragmentary sectional view of a button valve actuator having a filter in accordance with another embodiment of the invention.

Referring to FIG. 10, a button actuator 110 includes a body portion 112 having a mounting opening 114 and an annular operating leg 116. A first bore 118 and a second bore 120 cooperate to define a passageway for the liquid vapocoolant to be discharged in a jet stream. Accordingly, a nozzle mounting bore 122 has a nozzle 124 mounted therein. The nozzle 124 includes a nozzle orifice or opening 126. The nozzle 124 is similar to the nozzle 94.

In this embodiment, a filter 128 comprises a non-shedding napkin or paper material. A suitable paper filter material is KIMTEX P/N 33560 40 sold by Kimberly Clark. As illustrated, a small portion of the paper filter material weighing less than a gram is fitted into the bore 118 to block the entrance to the bore 120. In this manner, the liquid vapocoolant is filtered prior to being discharged through the nozzle 124.

In addition to metal and paper type filters, polymeric membranes of suitable porosity may be used as filters. A variety of suitable membranes are sold by the Whatman Group including a cellulose filter media having a separation size of 40 microns. Gelman, through Paul Life Sciences, also distributes a suitable cotton linter paper having a separation size of 30 microns.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

What is claimed:

1. An apparatus for discharge of vapocoolants in stream or mist form including a container of pressurized vapocoolant and a valve having at least one movable valve element operating with a sealing surface for regulating the vapocoolant discharge, said sealing surface comprising a fluoroelastomer selected to have:

a) a durometer change of 85±5, as measured by ASTM D2240;

b) a permeability measured as product loss from the assembled can through the valve assembly by gas chromatography in the range of 1 to 1.2 g/year;

c) chemical inertness in respect to ethyl chloride as characterized by gas chromatography characterization of impurities less than about 100 ppm;

d) a dimensional stability that exhibits limited dimensional change equal to ±5%;

e) a low solid residue in vapocoolant as characterized by an ethyl chloride USP non-volatile residue test of less than about 100 ppm.

2. An apparatus as in claim 1, wherein said fluoroelastomer a perfluoroelastomer.

3. An apparatus as in claim 1, wherein said fluoroelastomer is a copolymer of tetrafluoroethylene and perfluoromethyl vinyl ether.

4. An apparatus as in claim 1, wherein said apparatus includes a spring for biasing said valve element closed against said sealing surface with a valve actuation force in the range of from 5.5 lbs. to 8.0 lbs.

5. An apparatus as in claim 4, wherein said sealing surface is provided by a gasket having a thickness in the range of from about 0.039 inch to about 0.048 inch.

6. An apparatus as in claim 5, wherein said gasket has an annular shape and is mounted in said container with a central flow opening having a diameter in the range of from about 0.115" to about 0.125".

7. An apparatus as in claim 3, further including a button actuator for operating said valve.

8. An apparatus as in claim 7, wherein said button actuator includes a body portion formed of a first resin and a nozzle insert formed of a second resin, said nozzle insert including a tapered discharge bore extending to a nozzle opening.

9. An apparatus as in claim 8, wherein said nozzle opening has a major dimension of less than 0.015".

10. An apparatus as in claim 8, wherein said first and second resins are different.

11. An apparatus as in claim 8, wherein said nozzle insert is frictionally retained in a mounting bore in said body portion of said button actuator.

12. An apparatus as in claim 1, wherein said container comprises a metal can having inside surfaces coated with at least one polymer resin selected from the group consisting of polyamide/polyimide and epoxy/phenolic, and a dip tube formed of polytetraethylene.

13. A method for discharging vapocoolants in stream or mist form from a container of pressurized vapocoolant including a valve having at least one movable valve element cooperating with a sealing surface for regulating the vapocoolant discharge, said sealing surface comprising a fluoroelastomer selected to have:

a) a durometer change of 85±5, as measured by ASTM D2240;

b) a permeability measured as product loss from the assembled can through the valve assembly by gas chromatography in the range of 1 to 1.2 g/year;

c) chemical inertness in respect to ethyl chloride as characterized by gas chromatography characterization of impurities less than about 100 ppm;

d) a dimensional stability that exhibits limited dimensional change equal to ±5%;

e) a low solid residue in vapocoolant as characterized by an ethyl chloride USP non-volatile residue test of less than about 100 ppm, and operating said valve to discharge said vapocoolant.

14. A method as in claim 13, wherein said valve includes a button actuator operable to overcome a closing force applied to said movable valve element by a spring.

15. A method as in claim 13, wherein said fluoroelastomer is perfluoroelastomer.

16. A method as in claim 13, wherein said fluoroelastomer is a copolymer of tetrafluoroethylene and perfluoromethyl vinyl ether.

17. A method as in claim 13, wherein said apparatus includes a spring for biasing said valve element closed against said sealing surface with a valve actuation in the range of from 5.5 lbs. to 8.0 lbs.

18. An apparatus for discharge of vapocoolants in stream or mist form including a container for holding a pressurized supply of liquid vapocoolant, passageway means for conveying liquid vapocoolant from said supply thereof to a nozzle having a nozzle opening for emitting said vapocoolant in stream or mist form, a valve having at least one movable valve element operating with a sealing surface for regulating flow of vapocoolant through said passageway means, and a filter downstream of said valve and upstream of said nozzle opening for removing contaminants from vapocoolant conveyed through said passageway means.

19. An apparatus as in claim 18, wherein said filter is sized to restrict the flow of contaminants having a particle size greater than about 50 microns.

20. An apparatus as in claim 18, wherein said filter is a non-shedding paper filter, a sintered metal filter or a polymeric membrane.

21. An apparatus as in claim 18, wherein said filter comprises a sintered metal filter having pores for screening said contaminants.

22. An apparatus as in claim 21, wherein said filter pore size is 50±10 microns.

23. An apparatus as in claim 18, wherein said sealing surface is formed of a fluoroelastomer and said nozzle opening is formed of metal.

24. An apparatus as in claim 18, wherein said nozzle and filter comprise an assembly mounted to said container.

25. An apparatus as in claim 18, wherein said nozzle opening has a diameter in the range of from about 0.004" to about 0.015".

26. An apparatus as in claim 18, wherein said nozzle opening has a diameter in the range of from about 0.005" to about 0.009".

27. An apparatus as in claim 18, wherein said container includes a vapor space above said vapocoolant that is maintained at a pressure of from about 4 psi to about 60 psi at room temperature.

28. An apparatus as in claim 18, wherein said container includes a vapor space above said vapocoolant that is maintained at a pressure of from about 4 psi to about 8 psi at room temperature.

29. An apparatus as in claim 18, further including an actuator carried by said container and arranged to actuate said valve, said passageway means including a passageway bore extending through said actuator to convey liquid vapocoolant to said nozzle, said filter being mounted in said actuator to remove contaminants in liquid vapocoolant being conveyed through said passageway bore to said nozzle opening.

30. An apparatus as in claim 29, wherein said sealing surface is formed of a fluoroelastomer having:

a) a durometer 85±5, as measured by ASTM D2240;

b) a permeability measured as product loss from the assembled can through the valve assembly by gas chromatography in the range of 1 to 1.2 g/year;

c) chemical inertness in respect to ethyl chloride as characterized by gas chromatography characterization of impurities less than about 100 ppm;

d) a dimensional stability that exhibits limited dimensional change equal to ±5%;

e) a low solid residue in vapocoolant as characterized by an ethyl chloride USP non-volatile residue test of less than about 100 ppm.

31. A method for discharging vapocoolants in stream or mist form from a container of pressurized liquid vapocoolant, conveying liquid vapocoolant from said supply thereof through said passageway means to a nozzle having a nozzle opening for emitting said vapocoolant in stream or mist form, controlling flow of vapocoolant from said supply thereof to said nozzle means with a valve having at least one movable valve element operating with a sealing surface for regulating flow of vapocoolant through said passageway means, filtering said vapocoolant being conveyed through said passageway means downstream of said valve and upstream of said nozzle opening to remove contaminants, and operating said valve to emit said vapocoolant from said nozzle opening in stream or mist form.

32. A method as in claim 31, wherein said step of filtering said vapocoolant includes restricting the flow of contaminants having a particle size greater than about 50 microns.

33. A method as in claim 31, wherein said filter is a non-shedding paper filter, a porous sintered metal or a polymeric membrane.

34. A method as in claim 31, wherein said sealing surface is formed of a fluoroelastomer and said nozzle opening is formed of metal.

35. A method as in claim 31, wherein said step of filtering said vapocoolant includes restricting the flow of contaminants having a particle size greater than about 0.0005".

36. A method as in claim 31, wherein said step of filtering said vapocoolant includes restricting the flow of contaminants having a particle size greater than about 0.010".

37. A method as in claim 31, wherein said step of filtering said vapocoolant includes restricting the flow of contaminants having an elongate particle size greater than about 0.0005" by 0.010".

38. A method as in claim 31, wherein said step of filtering said vapocoolant includes restricting the flow of contaminants having a particle size greater than about 30 microns.

39. An apparatus for discharge of vapocoolants in stream or mist form including a container for holding a pressurized supply of liquid vapocoolant, passageway means for conveying liquid vapocoolant from said supply thereof to a nozzle having a nozzle opening for emitting said vapocoolant in stream or mist form, a valve having at least one movable valve element operating with a sealing surface for regulating flow of vapocoolant through said passageway means, and a filter for removing contaminants from vapocoolant conveyed through said passageway means upstream of said nozzle opening, said filter being sized to restrict the flow of particles larger than manufacturing debris resulting from the manufacture of plastics.

40. An apparatus as in claim 39, wherein said filter is sized to restrict the flow of contaminants having a particle size greater than about 0.0005".

41. An apparatus as in claim 39, wherein said filter is sized to restrict the flow of contaminants having a particle size greater than about 0.010".

42. A method as in claim 39, wherein said filter is sized to restrict the flow of contaminants having an elongate particle size greater than about 0.0005" by 0.010".

43. An apparatus as in claim 39, wherein said filter is sized to restrict the step of filtering said vapocoolant includes restricting the flow of contaminants having a particle size greater than about 30 microns.

44. An apparatus as in claim 39, further including a button actuator for operating said valve, said nozzle and said filter being mounted on said button actuator.

45. An apparatus as in claim 44, wherein said nozzle and said filter comprise a subassembly mounted on said button actuator.

46. An apparatus as in claim 45, wherein said nozzle and filter comprise engaged elements forming said subassembly.

47. An apparatus as in claim 45, wherein said button actuator includes a cap mounted to said container, said passageway means including a passageway bore in said cap, and said nozzle and said filter comprise cylindrical shaped elements fitted together to form a subassembly mounted in said passageway bore in said cap.

48. An apparatus as in claim 45, wherein said passageway means includes a passageway bore, said nozzle and said filter comprise a subassembly mounted in said passageway bore with said filter positioned upstream of said nozzle opening, said filter and said nozzle opening each having an area extending in a transverse direction across said passageway bore for passage of said vapocoolant, said filter area being substantially greater than said nozzle opening area.

49. An apparatus as in claim 39, wherein said nozzle and filter comprise a subassembly mounted on said container.

50. An apparatus as in claim 39, wherein said filter is located downstream of said valve and upstream of said nozzle opening.

51. An apparatus as in claim 50, wherein said nozzle and said filter comprise a subassembly mounted on said container.

52. An apparatus as in claim 49, wherein said nozzle and said filter comprises frictionally engaged elements forming said subassembly, said subassembly having a generally cylindrical shape and being mounted in said passageway means.

53. An apparatus as in claim 50, wherein said passageway means includes a passageway bore, said nozzle and said filter comprise a subassembly frictionally mounted in said passageway bore with said filter positioned upstream of said nozzle opening, said filter and said nozzle opening each having an area extending in a transverse direction across said passageway bore for passage of said vapocoolant, said filter area being substantially greater than said nozzle opening area.

* * * * *